US008112941B2

(12) United States Patent
Lenox et al.

(10) Patent No.: US 8,112,941 B2
(45) Date of Patent: Feb. 14, 2012

(54) CONSTRUCTION PRODUCT HAVING A MOVEABLE ELEMENT WITH MULTI-FUNCTIONAL THERMAL BREAK

(75) Inventors: Ronald M. Lenox, Cranberry Township, PA (US); Mahmoud Manteghi, Cranberry Township, PA (US); Heath Lewis, Pittsburgh, PA (US)

(73) Assignee: Alcoa Commercial Windows LLC, Pittsburgh, PA (US)

( * ) Notice: Subject to any disclaimer, the term of this patent is extended or adjusted under 35 U.S.C. 154(b) by 762 days.

(21) Appl. No.: 11/749,556

(22) Filed: May 16, 2007

(65) Prior Publication Data

US 2008/0282628 A1 Nov. 20, 2008

(51) Int. Cl.
*E06B 3/00* (2006.01)

(52) U.S. Cl. ..... 49/501; 49/67; 49/125; 49/176

(58) Field of Classification Search ..... 49/501, 49/505, 404, 61, 63, 125, DIG. 1; 52/717.02, 52/204.51
See application file for complete search history.

(56) References Cited

U.S. PATENT DOCUMENTS 3,436,884 A * 4/1969 Bell et al. ..... 52/202
3,462,884 A 8/1969 La Bissoniere
3,823,524 A 7/1974 Weinstein
3,925,953 A 12/1975 LaBorde
4,080,756 A * 3/1978 Heaney ..... 49/70
4,312,905 A * 1/1982 Kreusel ..... 428/122
4,344,257 A 8/1982 Anderson
4,398,372 A 8/1983 Anderson
4,423,578 A 1/1984 Meigs et al.
4,495,726 A * 1/1985 Lindstrom ..... 49/401
4,614,062 A * 9/1986 Sperr ..... 49/504
4,628,648 A 12/1986 Winyard
4,669,241 A 6/1987 Kelly
4,683,676 A 8/1987 Sterner, Jr.
4,688,366 A 8/1987 Schmidt
5,022,205 A 6/1991 Ford
5,038,537 A * 8/1991 Frambach ..... 52/207
5,088,258 A 2/1992 Schield et al.
5,187,867 A * 2/1993 Rawlings ..... 29/897.312
5,592,781 A * 1/1997 Mauro ..... 49/394
5,617,695 A 4/1997 Brimmer
5,632,118 A 5/1997 Stark
5,649,389 A * 7/1997 Coddens ..... 49/419
5,655,282 A 8/1997 Hodek et al.
5,916,681 A 6/1999 Cipin
6,033,995 A 3/2000 Muller
6,035,596 A * 3/2000 Brunnhofer ..... 52/404.1
6,058,653 A * 5/2000 Slocomb et al. ..... 49/181
6,338,227 B1 * 1/2002 Finke ..... 52/207
6,405,498 B1 6/2002 Riegelman
6,412,240 B1 7/2002 Treleven et al.

(Continued)

OTHER PUBLICATIONS

Official Action issued in connection with U.S. Appl. No. 11/749,519 mailed Aug. 31, 2010.

(Continued)

*Primary Examiner* — Blair M Johnson
*Assistant Examiner* — Catherine A Kelly
(74) *Attorney, Agent, or Firm* — Greenberg Traurig, LLP

(57) ABSTRACT

A construction product such as a window or door includes a multi-functional thermal break. The thermal break serves to contact and support elements of the sash of the construction product. The thermal break also provides one or more additional structural functions for the construction product.

8 Claims, 10 Drawing Sheets

U.S. PATENT DOCUMENTS

| | | | | |
|---|---|---|---|---|
| 6,485,122 | B2 | 11/2002 | Wolf et al. | |
| 6,500,550 | B1 | 12/2002 | Tsuboi et al. | |
| 6,633,320 | B2 | 10/2003 | Sogabe et al. | |
| 6,761,004 | B2 * | 7/2004 | Anglin et al. | 52/238.1 |
| 7,096,640 | B1 | 8/2006 | Chevian et al. | |

OTHER PUBLICATIONS

Official Action issued in connection with U.S. Appl. No. 11/749,519 mailed Mar. 31, 2010.

* cited by examiner

CONSTRUCTION PRODUCT HAVING A MOVEABLE ELEMENT WITH MULTI-FUNCTIONAL THERMAL BREAK

BACKGROUND

This application discloses an invention that is related, generally and in various embodiments, to a construction product having a multi-functional thermal break.

Windows, doors, and other construction products that serve as a barrier between the interior and exterior of a structure are most desirable when they have functional, aesthetically pleasing, and thermal insulating properties. However, prior art construction products are lacking in many of these features. In particular, products with moveable parts, such as windows and doors, may include a thermal barrier element in order to substantially block the passage of thermal energy between two elements. However, prior art thermal barriers exhibit several disadvantages. For example, they may not provide a substantial seal against external temperatures, they may not provide structural support for other elements of the construction product, or they may be structurally complicated and thus expensive and difficult to manufacture.

The embodiments described herein are directed to solving one or more of the problems described above.

SUMMARY

In an embodiment, a construction product such as a window or door includes a frame and a sash. The sash includes an interior portion, an exterior portion, and a thermal break. The thermal break is made of a rigid insulating material that connects and supports the interior portion and the exterior portion. The construction product also includes a support member that is operatively connected to the sash and which supports the sash when the sash is in multiple positions. The thermal break defines a cavity that accepts the support member. The frame may be made of a material such as aluminum, while the thermal break may be made of a different material such as a polymer.

Optionally, the interior portion includes a first rail portion, the exterior portion includes a second rail portion, and the support member is a pivot bar. In such an embodiment, the cavity may surround the pivot bar. The sash also may include a glazing component. The construction product also may, in some embodiments, include a second thermal break that further connects and supports the interior portion and the exterior portion.

In some embodiments, the frame may include a first sill portion, a second sill portion, and an additional thermal break that connects and supports the first and second sill portions.

In another embodiment, a construction product includes a frame and a first sash. The first sash includes an interior first sash portion, an exterior first sash portion, and a first thermal break. The first thermal break comprising may be made of an insulating material that connects and supports the interior first sash portion and the exterior first sash portion. A first support member may be operatively connected to the first sash so that it supports the first sash when the first sash is multiple positions. The first thermal break may define a cavity that accepts the first support member. The construction product also may include a second sash that includes an interior second sash portion, an exterior second sash portion, and a second thermal break. The second thermal break may be made of an insulating material that connects and supports the interior second sash portion and the exterior second sash portion. A second support member may be operatively connected to the second sash so that it supports the second sash when the second sash is in multiple positions, the second thermal break may define a cavity that accepts the second support member. The frame may be made of a material such as aluminum, while the thermal break may be made of a different material such as a polymer Optionally, the frame may include a first sill portion, a second sill portion and an additional thermal break that connects and supports the first and second sill portions.

BRIEF DESCRIPTION OF THE DRAWINGS

Various embodiments of the invention are described herein by way of example in conjunction with the following figures.

DETAILED DESCRIPTION

Figure 1:
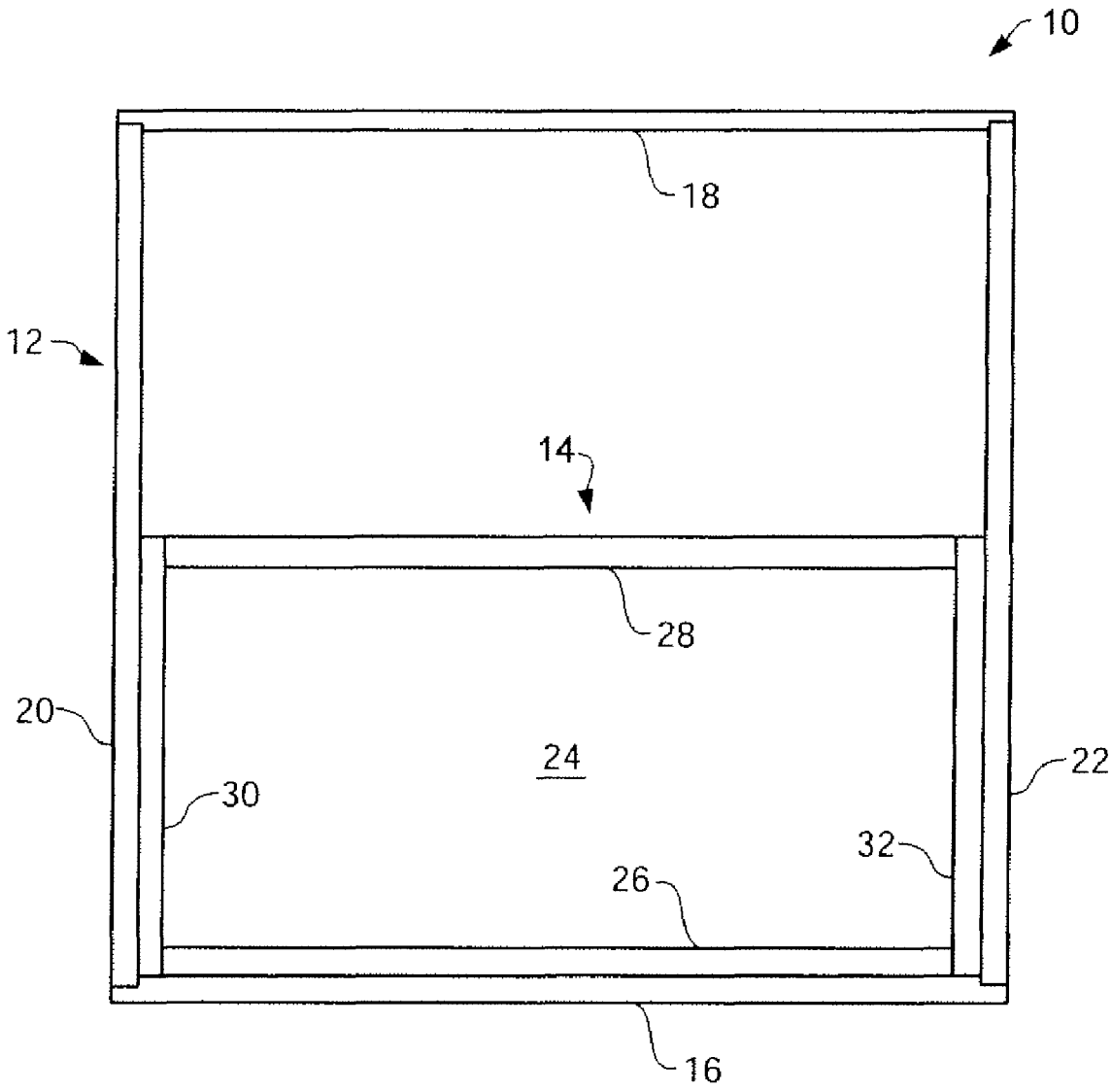
FIG. 1 illustrates various embodiments of a construction product, in this example a window with a sash.

Before the present methods, systems and materials are described, it is to be understood that this disclosure is not limited to the particular methodologies, systems and materials described, as these may vary. It is also to be understood that the terminology used in the description is for the purpose of describing the particular versions or embodiments only, and is not intended to limit the scope. For example, as used herein and in the appended claims, the singular forms "a," "an," and "the" include plural references unless the context clearly dictates otherwise. In addition, the word "comprising" as used herein is intended to mean "including but not limited to." Unless defined otherwise, all technical and scientific terms used herein have the same meanings as commonly understood by one of ordinary skill in the art, FIG. 1 illustrates various embodiments of a construction product 10. The construction product 10 may be embodied as, for example, a single hung window or a double hung window. The construction product 10 includes a frame 12, and a sash 14 surrounded by the frame 12.

The frame 12 includes a sill 16, a head 18, a first jamb 20 connected to the sill 16 and the head 18, and a second jamb 22 connected to the sill 16 and the head 18. The sill 16, the head 18, and the first and second jambs 20, 22 may each be fabricated from any suitable material. According to various embodiments, at least a portion of the sill 16, the head 18, the first jamb 20 and/or the second jamb 22 is fabricated from a metal. The metal may include for example, aluminum.

For purposes of clarity, only one sash 14 is shown in FIG. 1. However, those skilled in the art will appreciate that the construction product 10 may include any number of sashes 14. For embodiments having two sashes 14, one of the sashes 14 may be considered the "top" sash and the other of the sashes 14 may be considered the "lower" sash as understood by those skilled in the art. A given sash 14 may be embodied as either a fixed sash or a moveable sash, and the construction product 10 may include any combination of fixed and/or moveable sashes 14.

The sash 14 includes a glazing component 24. The glazing component 24 is an element through which light may pass, and it may be of any suitable material. For example, according to various embodiments, the glazing component 24 may be an insulated glass. As shown in FIG. 1, the sash 14 may also include a rail 26, a checkrail 28, a first stile 30 connected to the rail 26 and the checkrail 28, and a second stile 32 connected to the rail 26 and the checkrail 28. The rail 26, the checkrail 28, and the first and second stiles 30, 32 may each be fabricated from any suitable material. According to various embodiments, at least a portion of the rail 26, the checkrail 28, the first stile 30 and/or the second stile 32 is fabricated from a metal. The metal may include, for example, aluminum.

Figure 2:
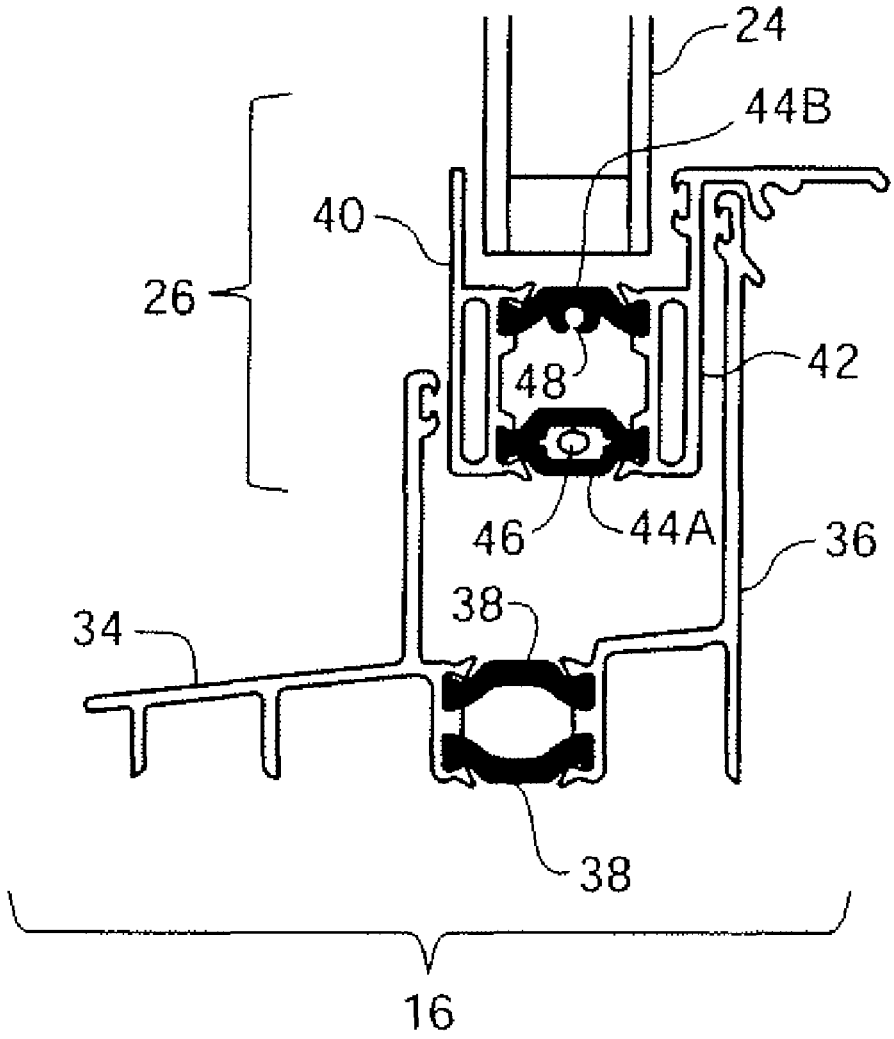
FIG. 2 illustrates a cross-section of the construction product of FIG. 1 according to various embodiments.

FIG. 2 illustrates a cross-section of a portion of the construction product of FIG. 1, according to various embodiments, and shows the sill 16 portion of the frame and the rail 26 portion of the sash. The sill 16 receives the sash 26 when the sash is in a closed position. The sill 16 includes a first sill portion 34, a second sill portion 36, and a thermal break 38 connected to the first and second sill portions 34, 36. The first sill portion 34 may be considered an "exterior" portion of the frame, and the second sill portion 36 may be considered an "interior" portion of the frame. The thermal break 38 may be fabricated from any suitable material. According to various embodiments, the thermal break 38 is fabricated from a polymer. The polymer may include, for example, a polyamide. The thermal break 38 operates to limit thermal conduction between the first and second sill portions 34, 36. The sill 16 may include any number of thermal breaks 38. For example, according to various embodiments, the sill 16 may include two thermal breaks 38 connected to the first and second sill portions 34, 36 as shown in FIG. 2.

The rail 26 includes a first rail portion 40, a second rail portion 42, and a two-piece thermal break 44A/B (collectively referred to herein as element 44) connected to the first and second rail portions 40, 42. As shown in FIG. 2, the glazing component 24 is between the first and second rail portions 40, 42. The first rail portion 40 may be considered an "exterior" portion of the sash, and the second rail portion 42 may be considered an "interior" portion of the sash. The thermal break (shown made of two portions 44A and 44B, collectively referred to herein as 44) may be fabricated from any suitable material. According to various embodiments, the thermal break 44 is fabricated from a polymer. The polymer may include, for example, a polyamide. The thermal break 44 operates to limit thermal conduction between the first and second rail portions 40, 42. The rail 26 may include any number of thermal break portions 44. For example, according to various embodiments, the rail 26 may include a two-part thermal break 44A/44B connected to the first and second rail portions 40, 42 as shown in FIG. 2. For such embodiments, one of the thermal break portions 44A may define a cavity that accepts and surrounds a pivot bar 46 of the construction product, and the other of the thermal break portions 44B may define at least a portion of a cavity that accepts a screw, i.e., a screw boss 48. The pivot bar 46 may be utilized to pivot and support the sash 14 in multiple positions as is known in the art. The screw boss 48 may be used to receive a screw which serves to connect the first or second stile (30, 32 in FIG. 1) with the rail 26. From the foregoing, one skilled in the art will appreciate that the thermal break 48 is a multi-functional thermal break.

Figure 3:
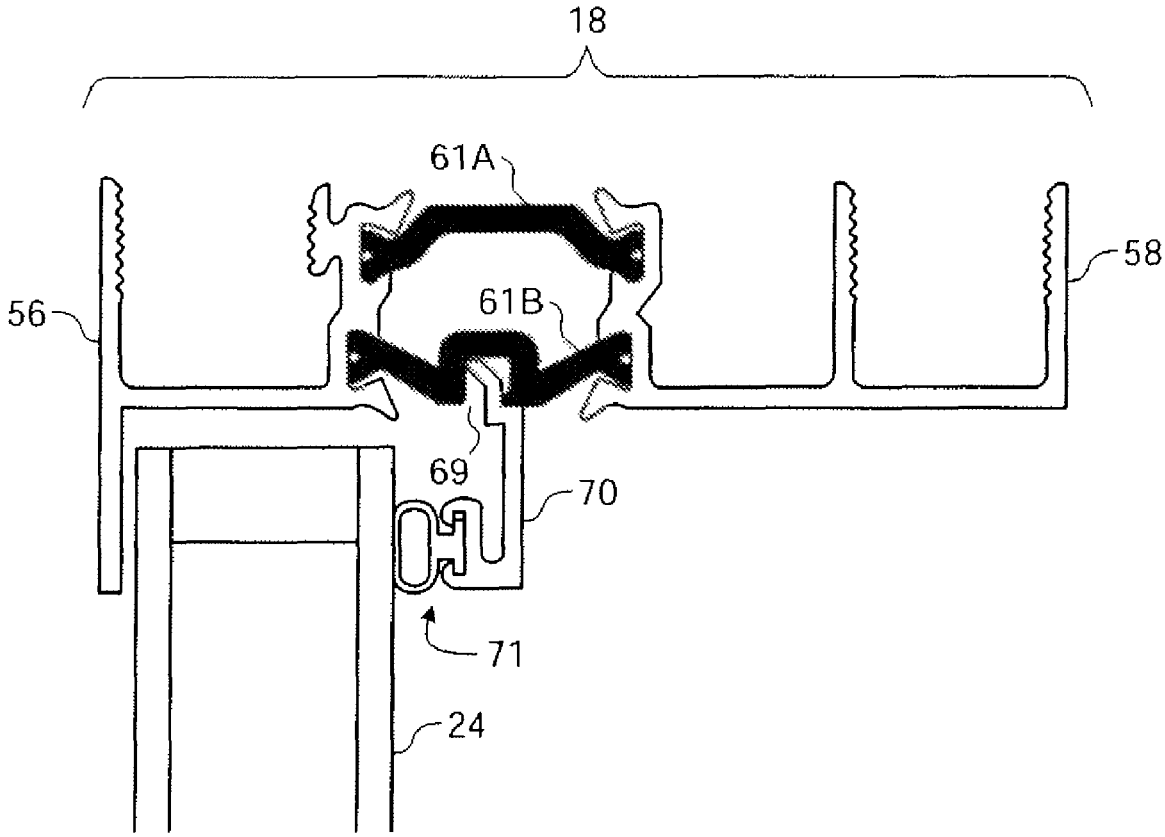
FIG. 3 illustrates another cross-section of a construction product such as that shown in FIG. 1 according to various embodiments.

FIG. 3 illustrates a cross-section of a portion of a construction product such as that shown in FIG. 1, and shows the head 18 of the frame and a glazing component 24. As shown in FIG. 3, a thermal break 61 is made up of elements 61A and 61B (collectively referred to herein as element 61). A thermal break portion 61B may be configured to define at least a portion of a cavity 69 that receives a glazing bead 70 of the construction product and holds the glazing bead 70 in place. As shown in FIG. 3, the cavity 69 may be defined on at least three sides and optionally on a portion of the fourth side, by the thermal break portion 61B. A weather strip 71 may be connected to the glazing bead so that it also contacts the glazing component 24 and provides a weather-resistant seal. The glazing bead 70 may support the glazing component 24 during construction, and thereafter the glazing bead 70 may serve an aesthetic function and shield the edge of glazing component 24 from view. The glazing bead 70, when connected to the thermal break portion 61B, cooperates with the first head potion 56 to fix the position of the "upper" sash, and in particular the glazing component 24. Alternatively, elements 56 and 58 may make up a portion of a sash 18 and thermal break 61B may cooperate with sash portions 56 and 58. Accordingly, the thermal break 61 is a multi-functional in that it provides both insulating and structural functions.

Figure 4:
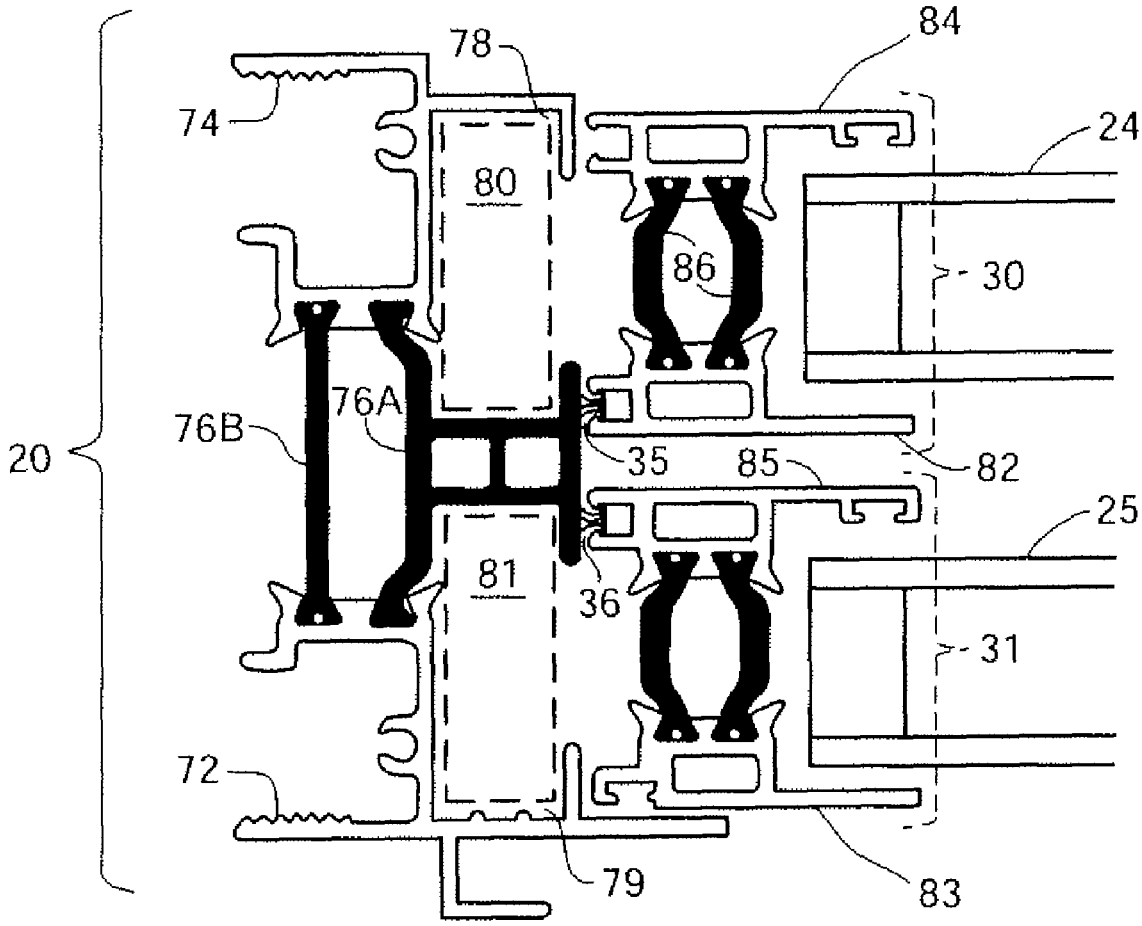
FIG. 4 illustrates another cross-section of a construction product such as that shown in FIG. 1 according to various embodiments.

FIG. 4 illustrates a cross-section of a portion of a construction product such as that shown in FIG. 1. In this embodiment, a window is shown with the first jamb 20 of the frame, a first stile 30 of each of a first moveable sash. The stile 30 receives and supports a glazing component 24. The embodiment shown in FIG. 4 may include two or more moveable sashes, and thus is shown with a second stile 31 relating to a second moveable sash 25. The first jamb 20 includes a first jamb portion 72, a second jamb portion 74, and a thermal break 76A connected to the first and second jamb portions 72, 74. The First jamb portion 72 may be considered an "exterior" portion of the frame, and the second jamb portion 74 may be considered an "interior" portion of the frame. The thermal break 76A may be fabricated from any suitable material to provide a rigid or semi-rigid structural support. According to various embodiments, the thermal break 76A is fabricated from a polymer. The polymer may include, for example, a polyamide. The thermal break 76A operates to limit thermal conduction between the first and second jamb portions 72, 74. The first jamb 20 may include any number of thermal breaks. For example, according to various embodiments, the first jamb 20 may include two thermal breaks 76A and 76B connected to the first and second jamb portions 72, 74 as shown in FIG. 4. One of the thermal breaks 76A cooperates with one of the Jamb portions 74 to define a first cavity 78 that houses a moveable component 80 of the construction product. The thermal break 76A is structured to provide a U-shaped wall that defines at least a portion each of three sides of cavity 78, while the jamb portion 74 also provides at least a portion of three sides of the cavity 78. As shown in FIG. 4, cavity 78 need not be entirety enclosed. The moveable component 80 may be, for example, a counterbalance mechanism connected to the sash 24 or a tilt shoe connected to the pivot bar of the construction product. The moveable component 80 supports the sash in multiple positions, including various open positions. Accordingly, thermal break 76A is a multi-functional thermal break in that it provides both insulating and structural support functions.

The first stile 30 includes a first stile portion 82, a second stile portion 84, and a thermal break 86 connected to the first and second stile portions 82, 84. As shown in FIG. 4, the glazing component 24 is between the first and second stile portions 82, 84. The first stile portion 82 may be considered an "exterior" portion of the sash 14, and the second stile portion 84 may be considered an "interior" portion of the sash 14. The thermal break 86 may be fabricated from any suitable material. According to various embodiments, the thermal break 86 is fabricated from a polymer. The polymer may include, for example, a polyamide. The thermal break 86 operates to limit thermal conduction between the first and second stile portions 82, 84. The first stile 30 may include any number of thermal breaks 86. For example, according to various embodiments, the first stile 30 may include two thermal breaks 86 connected to the first and second stile portions 82, 84 as shown in FIG. 4.

Optionally, where a second moveable sash 25 is provided the thermal break 76A may define not only a portion of first cavity 78, but also a portion of second cavity 79. Thermal break 76A provides a U-shaped wall that defines at least a portion of three sides of second cavity 79. Second cavity 79 holds a second moveable component 81. Second moveable component 81 may be, for example, a counterbalance mechanism connected to sash 25 or a tilt shoe connected to a pivot bar of the construction product. Where a second sash 25 is used, a corresponding first stile portion 83 and second stile portion 85 may be used to accept the second sash 25. Either or both of the second (interior) stile portions 82, 83 may include a weather strip 35, 36 that extends from its corresponding stile portion and contacts the thermal break to form a weather-resistant seal.

Figure 5:
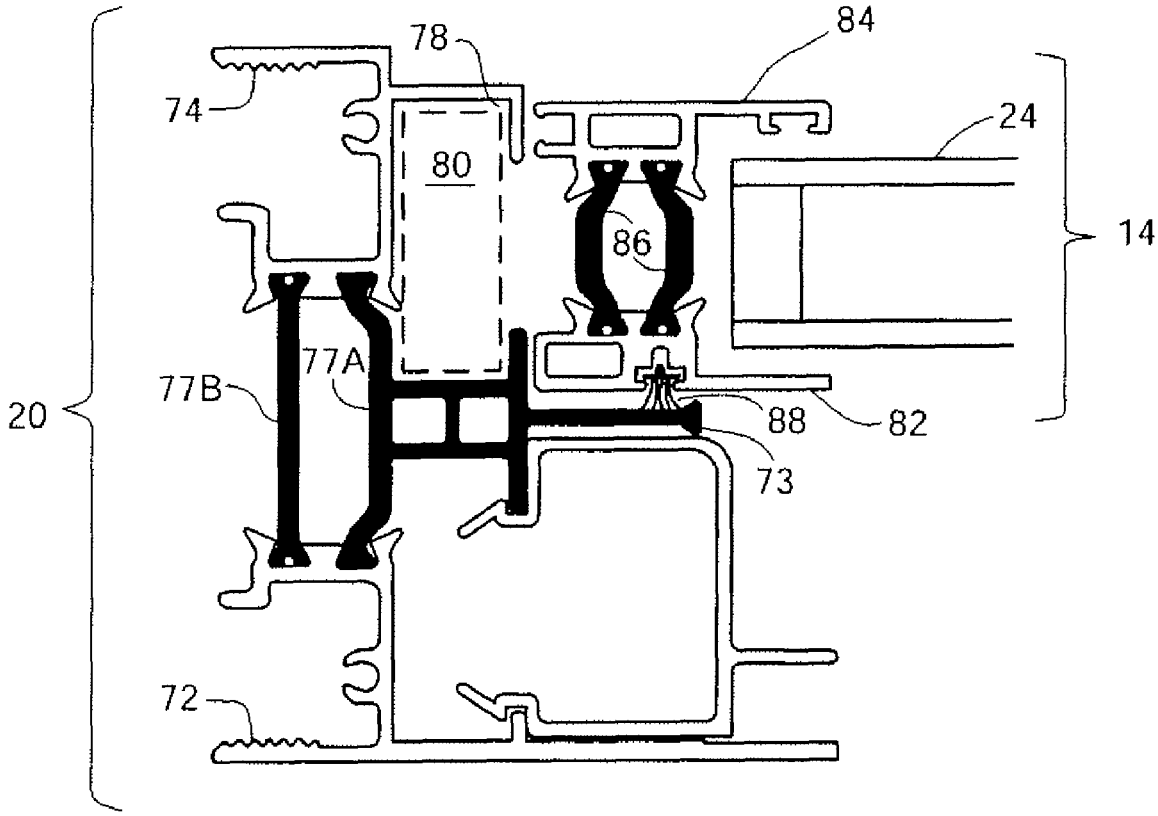
FIG. 5 illustrates a variation of the cross section of FIG. 4.

FIG. 5 is a variation of the embodiment of FIG. 4 and it illustrates a cross-section of construction product with an "interior" moveable sash 14 and the first jamb 20 of the frame below the checkrail of the "interior" moveable sash 14. Although otherwise similar to a portion of FIG. 4 with a single sash 24, in FIG. 5 the sash 82 includes a flexible portion 88 which is in contact with an extended member 73 of the thermal break 77A. The flexible portion 88 may operate as a weather strip so that when weather strip 88 contacts the thermal break 77A a water-resistant seal is provided.

Figure 6:
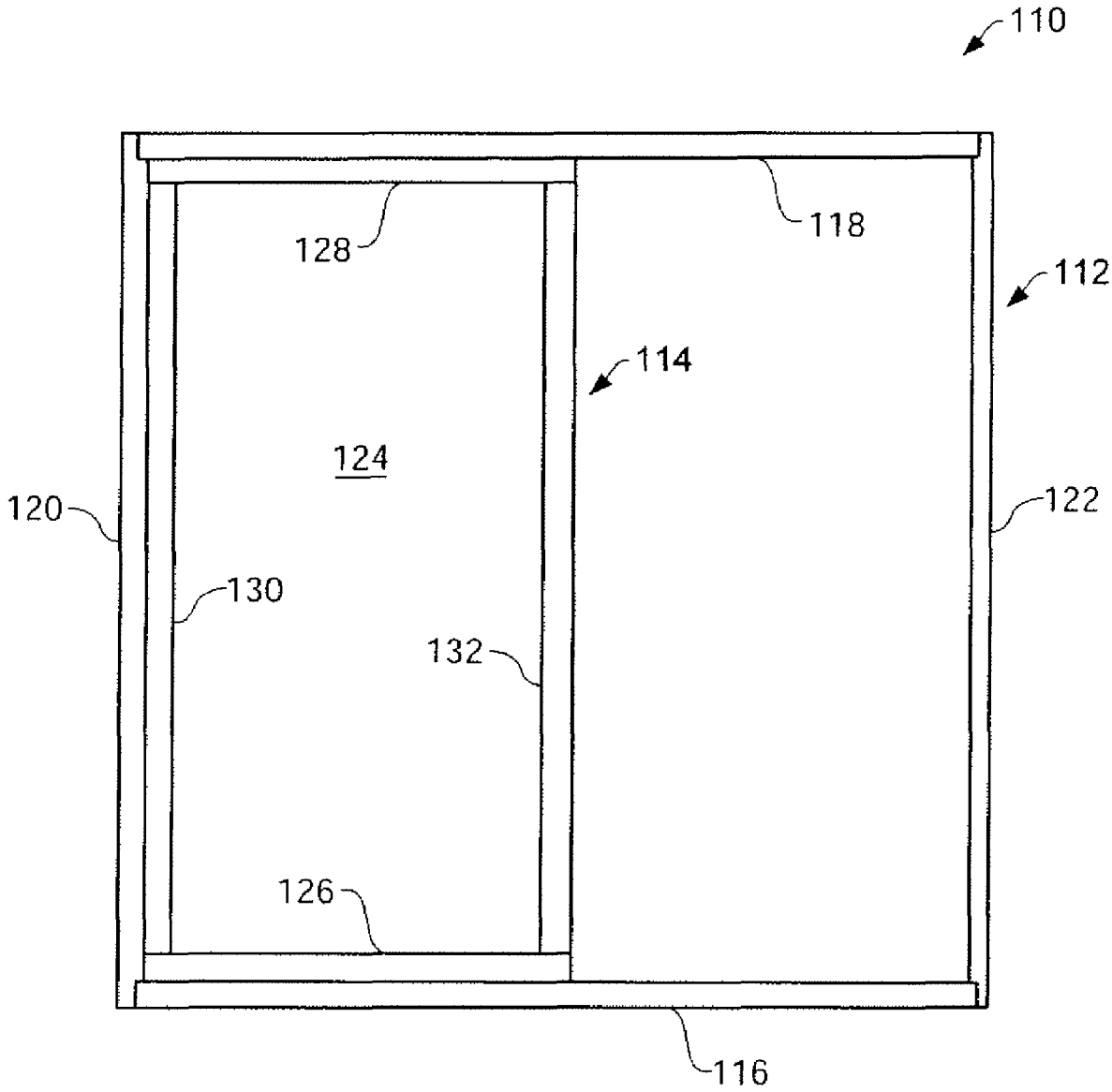
FIG. 6 illustrates an alternate embodiment of a construction product, in this example a sliding window or door.

FIG. 6 illustrates an alternate embodiment of a construction product 110, in this example a sliding window or door The construction product 110 includes a frame 1127 and a sash 114 surrounded by the frame 112.

The frame 112 includes a sill 116, a head 118, a first jamb 120 connected to the sill 116 and the head 118, and a second jamb 122 connected to the sill 116 and the head 118. The sill 116, the head 118, and the first and second jambs 120, 122 may each be fabricated from any suitable material. According to various embodiments, at least a portion of the sill 116, the head 118, the first jamb 120 and or the second jamb 122 may be fabricated from a metal. The metal may include, for example, aluminum.

For purposes of clarity, only one sash 114 is shown in FIG. 6. However, those skilled in the art will appreciate that the construction product 110 may include any number of sashes 114. A given sash 114 may be embodied as either a fixed sash or a moveable sash, and the construction product 110 lay include any combination of fixed and/or moveable sashes 114. For embodiments having two or more sashes 114, at least one sash 114 may be considered the "exterior" sash and at least one sash 114 may be considered the "interior" sash.

The sash 114 includes a glazing component 124. The glazing component 124 may be of any suitable material. For example, according to various embodiments, the glazing component 124 may be an insulated glass. As shown in FIG. 6, the sash 114 may also include a first rail 126, a second rail 128, a first stile 130 connected to the first and second rails 126, 128, and a second stile 132 connected to the first and second rails 126, 128. The first rail 126 may be considered the "lower" rail and the second rail 128 may be considered the "upper" rail. The first and second rails 126, 128 and the first and second stiles 130, 132 may each be fabricated from any suitable material. According to various embodiments, at least a portion of the first rail 126, the second rail 128, the first stile 130 and/or the second stile 132 may be fabricated from a metal. The metal may include, for example, aluminum.

Figure 7:
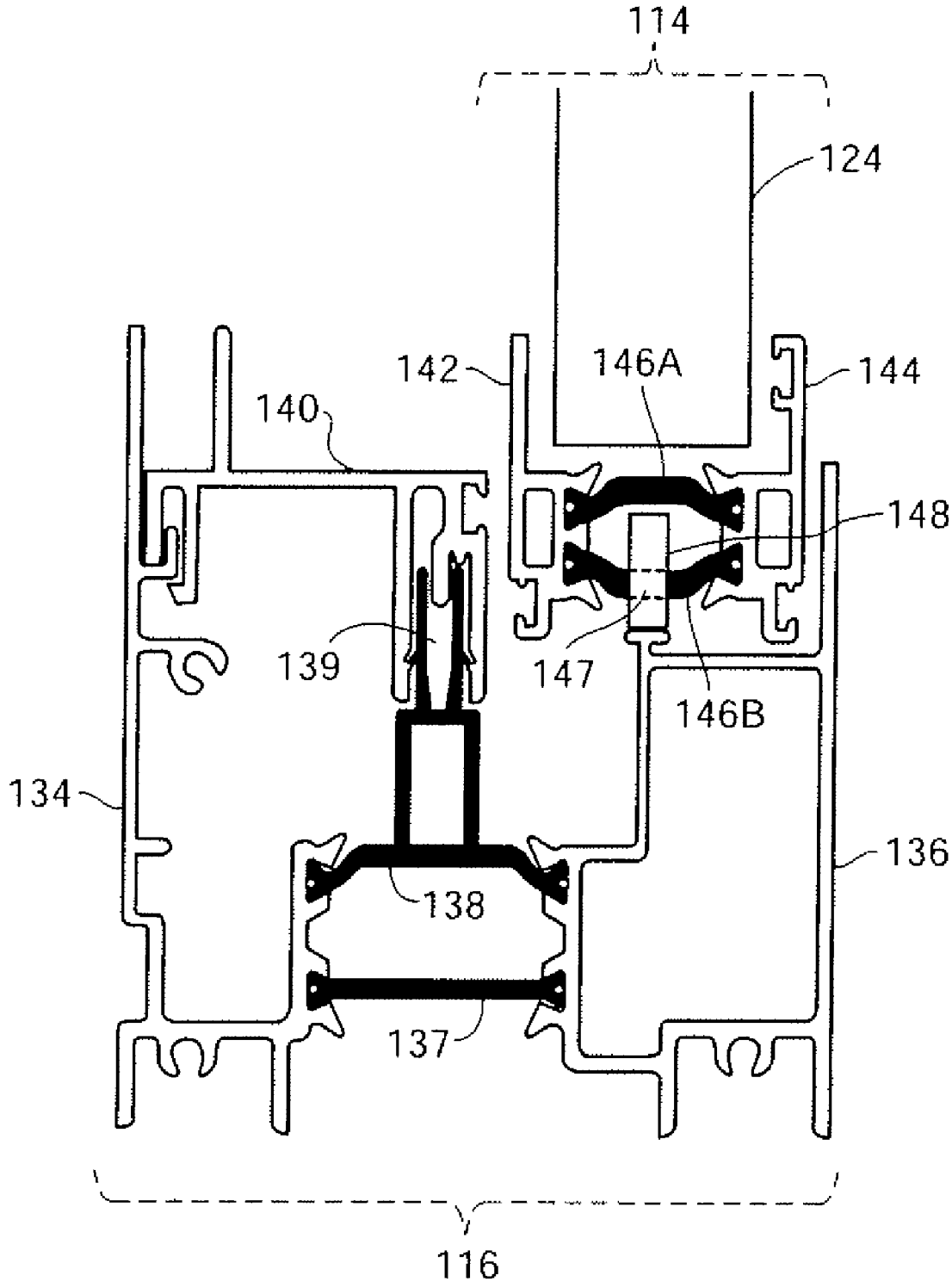
FIG. 7 illustrates a cross section of a portion of the construction product of FIG. 6.

FIG. 7 illustrates a cross-section of a construction product such as that shown in FIG. 6, and it shows a portion of a sill 116 of a frame. The sill 116 receives the first rail of a moveable sash 114. The sill 116 includes a first sill portion 134, a second sill portion 136, and a thermal break 138 (in this example made of two portions 138A and 138B) connected to the first and second sill portions 134, 136. The first sill portion 134 may be considered an "exterior" portion of the frame, and the second sill portion 136 may be considered an "interior" portion of the sill 116. The thermal break 138 may be fabricated from any suitable rigid or semi-rigid material. According to various embodiments, the thermal break 138 is fabricated from a polymer that has both thermal insulation and structural support properties. The polymer may include, for example, a polyamide. The thermal break 138 operates to limit thermal conduction between the first and second sill portions 134, 136. The sill 116 may include any number of thermal breaks 138. For example, according to various embodiments, the sill 116 may include two thermal break portions 138A and 138B connected to the first and second sill portions 134, 136 as shown in FIG. 7.

As shown in FIG. 7, the sill 116 may also include a rigid member 140 connected to the first sill portion 134 and the thermal break 138. The rigid member 140 may be fabricated from any suitable material. According to various embodiments, the rigid member 140 may be fabricated from a plastic, the plastic may include, for example, a polyvinyl chloride. The rigid member 140 may cooperate with the first sill portion 134 and the thermal break 138 to increase the strength and/or stiffness of the sill 116. The thermal break 138 defines at least a portion, and in FIG. 7 three sides of a cavity 139 that accepts the rigid member 140 of the sill 116. Accordingly, the thermal break 138 is a multi-functional thermal break in that it serves both insulating and structural functions. Optionally, a second thermal break 137 may cooperate with first sill portion 134 and second sill portion 136 to further increase the strength of the sill 116.

Figure 8:
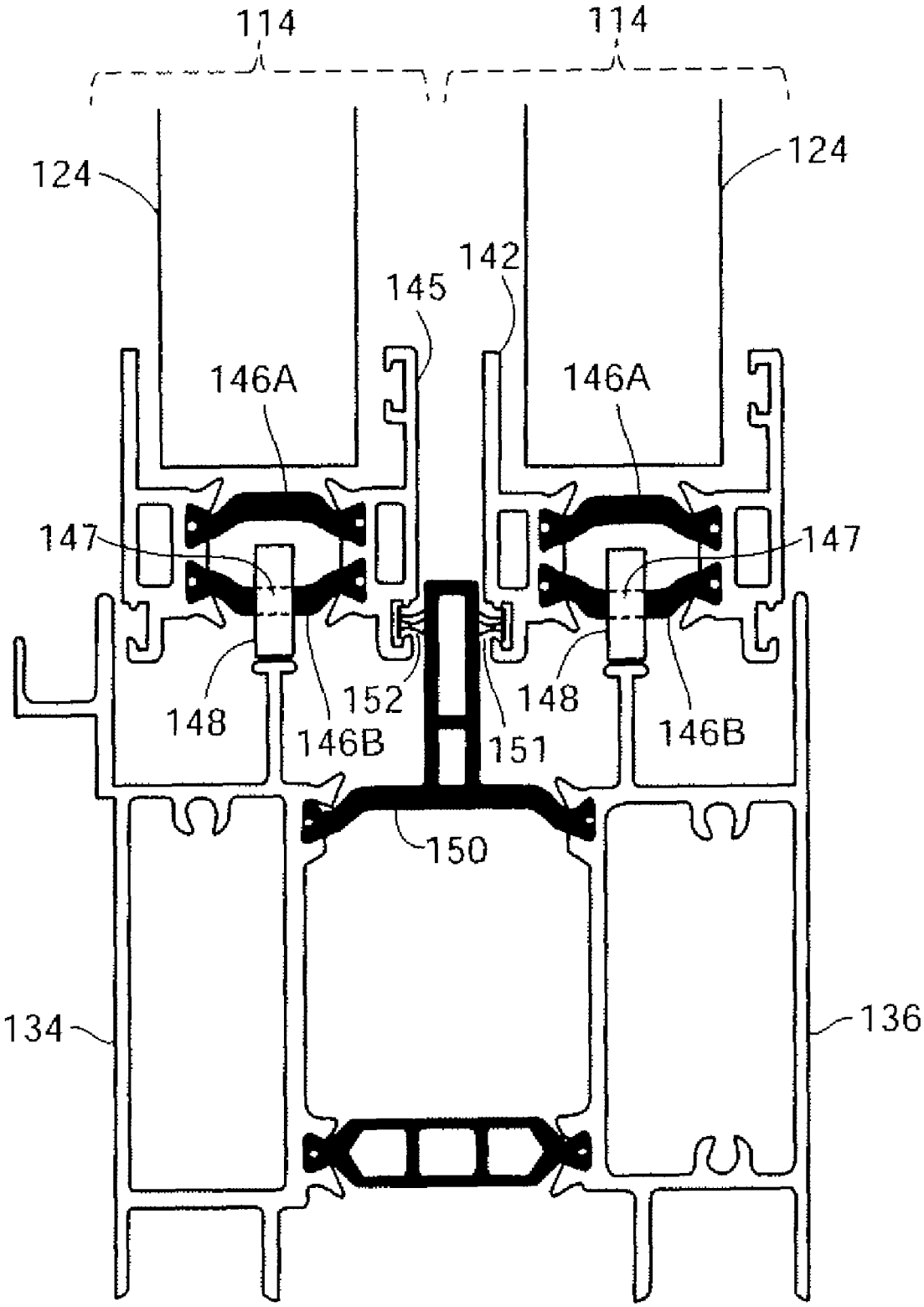
FIG. 8 illustrates a variation of the embodiment of FIG. 7 including two sashes.

The first rail of moveable sash 114 includes a first rail portion 142, a second rail portion 144, and a thermal break 146 (in this example made of two portions 146A and 146B) connected to the first and second rail portions 142, 144. As shown in FIG. 7, the glazing component 124 is between the first and second rail portions 142, 144. The first rail portion 142 may be considered an "exterior" portion of the sash 114, and the second rail portion 144 may be considered an "interior" portion of the sash 114. The thermal break 146 may be fabricated from any suitable rigid material. According to various embodiments, the thermal break 146 is fabricated from a polymer. The polymer may include, for example, a polyamide. The thermal break 146 operates to limit thermal conduction between the first and second rail portions 142, 144. The first rail 126 may include any number of thermal breaks or thermal break portions 146A and 146B. For example, according to various embodiments, the first rail 126 may include two thermal break portions 146A and 146B connected to the first and second rail portions 142, 144 as shown in FIG. 7. A thermal break or thermal break portion 146B may surround or receive a roller mechanism 148 of the construction product. The cavity 147 may be an opening to receive the roller 148 into the thermal break as shown in FIG. 8. Alternatively, the cavity 147 may be an indentation or groove that simply receives and guides the roller along the thermal break portion 146$. The roller mechanism 148 may be use to slide the sash 114 as is known in the art. From the foregoing, the thermal break 146 is a multi-functional thermal break.

FIG. 8 shows a variation on the embodiment of FIG. 7 in which thermal break 150 provides thermal insulation and support between a first sill portion 134 and second sill portion 136. This embodiment includes two sashes 114, each including a glazing component 124, and a two-part thermal break 146 that includes a portion 146B with a cavity 147 that receives a roller mechanism 148. Thus, the embodiment shown in FIG. 8 may be, for example, a double sliding door mechanism. Optionally, one or more interior rail portions 142, 145 may include a weather strip 151, 152 that extends from its corresponding rail portion and creates a water-resistant seal by contacting the thermal break 139. Alternatively, the weather strip portions 151 and 152 may be integral with thermal break 150 and may extend into rail portions 142 and 145.

Figure 9:
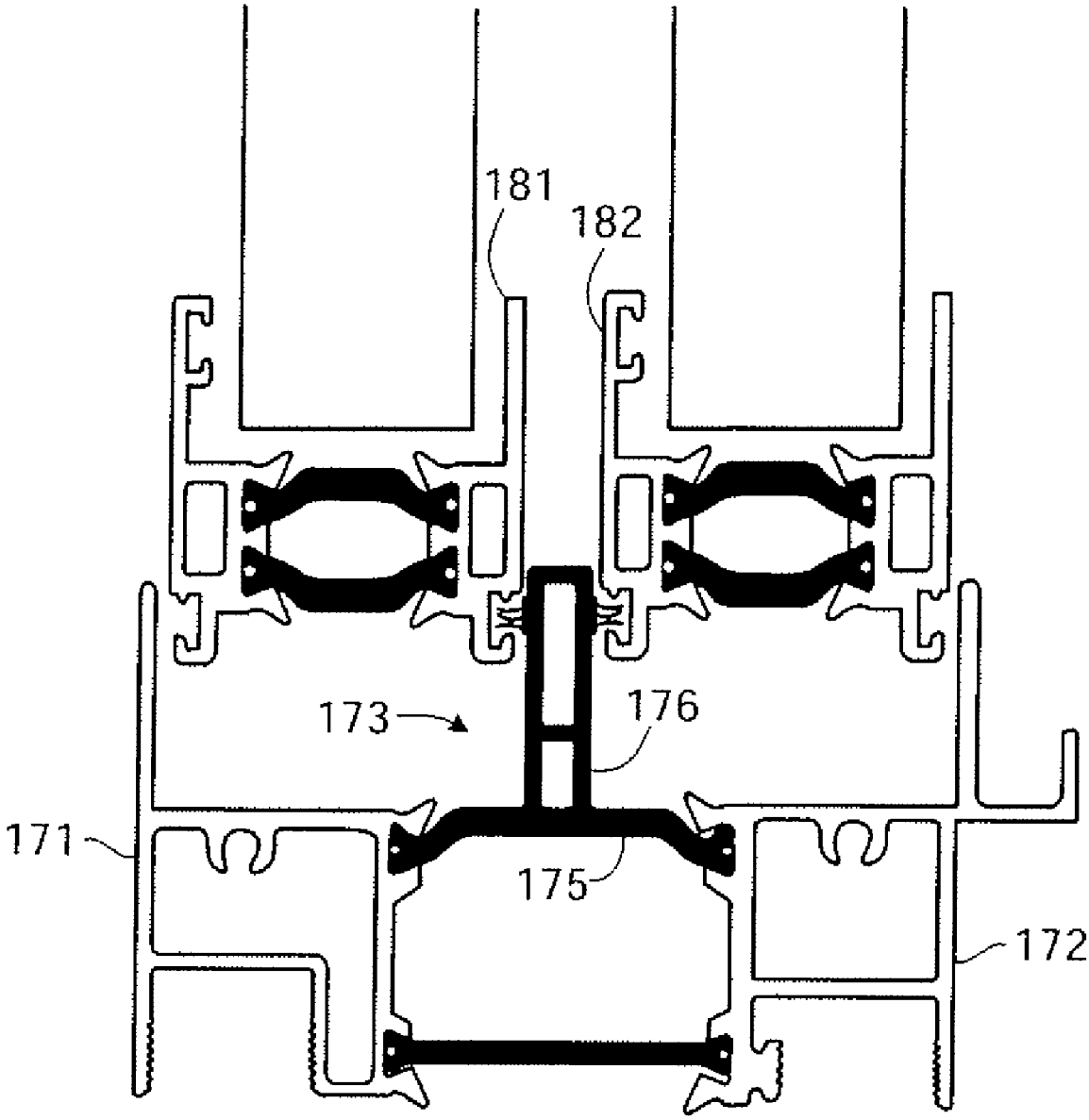
FIG. 9 illustrates a double-sliding window or door.

FIG. 9 shows an embodiment of a double-sliding window or door with a head including a first head portion 171 and a second head portion 172 and a thermal break 173 that connects and supports the first and second head portions. Thermal break 173 includes a first member 175 and a second member 176. The first member 175 connects and supports the first head portion 171 and second head portion 172. The second member 176 is connected to the first member 175, extends in a substantially perpendicular direction from first member 175. Second member 176 either receives one or more weather strips 177, 178 from one or both rail portions 181, 182, or second member 176 includes one or more weather strips 177, 178 that extend and contact one or both rail portions 181, 182.

Figure 10:
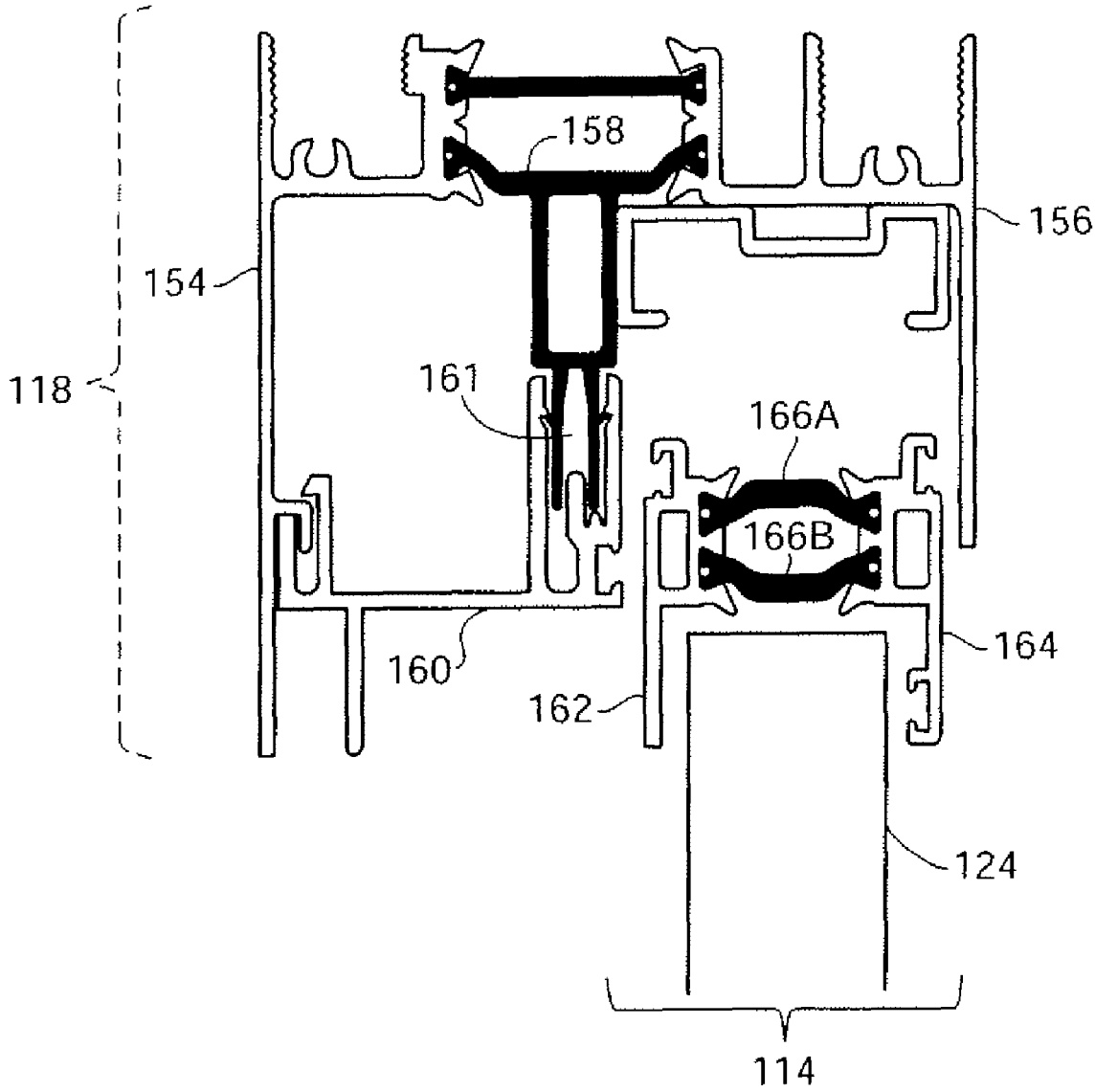
FIG. 10 illustrates a construction product such as that shown in FIG. 6 with a moveable sash.

FIG. 10 illustrates a cross-section of a construction product such as that shown in FIG. 7 according to various embodiments, and shows the head 1 IS of the frame. The head 118 receives the second rail of a moveable sash 114. The head 118 includes a first head portion 154, a second head portion 156 and a thermal break 158 connected to the first and second head portions 154, 156. The first head portion 154 may be considered an "exterior" portion of the frame, and the second head portion 156 may be considered an "interior" portion of the frame. The thermal break 158 may be fabricated from any suitable material. According to various embodiments, the thermal break 158 is fabricated from a polymer. The polymer may include, for example, a polyamide. The thermal break 158 operates to limit thermal conduction between the first and second head portions 154, 156. The head 118 may include any number of thermal breaks 158. For example, according to various embodiments, the head 118 may include two thermal break portions connected to the first and second head portions 154, 156 as shown in FIG. 10.

As shown in FIG. 10, the head 118 may also include a rigid member 160 connected to the first head portion 154 and the thermal break 158. The rigid member 160 may be fabricated from any suitable material. According to various embodiments, the rigid member 160 may be fabricated from a plastic. The plastic may include, for example, a polyvinyl chloride. The rigid member 160 may extend into a cavity 161 of the thermal break 158 cooperate with the first head portion 154 and the thermal break 158 to increase the strength and/or stiffness of the head 118. Thus, the thermal break 158 is a multi-functional thermal break in that it provides thermal insulation and supports the structure of the head.

The second rail 128 includes a first rail portion 162, a second rail portion 164, and a thermal break 166 (made of portions 166A and 166B) connected to the first and second rail portions 162, 164. As shown in FIG. 10, the glazing component 124 is positioned between and supported by the first and second rail portions 162, 164. The first rail portion 162 may be considered an "exterior" portion of the sash 114, and the second rail portion 164 may be considered an "interior" portion of the sash 114. The thermal break 166 may be fabricated from any suitable material. According to various embodiments, the thermal break 166 is fabricated from a polymer. The polymer may include, for example, a polyamide. The thermal break 166 operates to limit thermal conduction between the first and second rail portions 162, 164, and it also supports the first and second rail portions 162, 164. The second rail 128 may include any number of thermal breaks 166. For example, according to various embodiments, the second rail 128 may include two or more thermal break portions 166A and 166$ connected to the first and second rail portions 162, 164 as shown in FIG. 10.

While several embodiments of the invention have been described herein by way of example, those skilled in the art will appreciate that various modifications, alterations, and adaptions to the described embodiments may be realized without departing from the spirit and scope of the invention defined by the appended claims.

What is claimed is:

1. A construction product, comprising:

a frame having a sill, a head, a first jamb and a second jamb;

at least one sliding sash window, wherein the at least one sliding sash window slides up and down within the frame, comprising:

a rail fabricated from a metal and having an interior rail portion and an exterior rail portion;

a checkrail fabricated from a metal;

a first stile fabricated from a metal;

a second stile fabricated from a metal; and a thermal break fabricated from a polymer, the thermal break being an additional component other than the rail, the checkrail, the first stile, and the second stile, wherein the thermal break is only positioned between the interior rail portion and the exterior rail portion of the sliding sash window, and wherein the thermal break has a single central hollowed-out cavity, the thermal break comprising an insulating material that connects and supports the interior rail portion and the exterior rail portion, and operates to limit thermal conduction between the interior rail portion and the exterior rail portion; and a pivot bar having a first end, a second end, and a longitudinal axis therebetween, wherein the first end of the pivot bar and at least a portion of the longitudinal axis of the pivot bar is positioned within and completely encircled by the cavity of the thermal break, and wherein the second end of the pivot bar projects out from the thermal break towards the second jamb of the frame so as to support the at least one sliding sash window when the at least one sliding sash window is in one of a plurality of positions.

2. The construction product of claim 1 wherein the at least one sliding sash window further comprises a glazing component.

3. The construction product of claim 1 further comprising a second thermal break that further connects and supports the interior rail portion and the exterior rail portion, and wherein the second thermal break includes a screw boss.

4. The construction product of claim 1, wherein:
the frame comprises aluminum.

5. The construction product of claim 1, wherein:
the frame comprises a first sill portion, a second sill portion, and a thermal break that connects and supports the first and second sill portions.

6. A construction product, comprising:
a frame having a sill, a head, a first jamb and a second jamb;
a first sliding sash window comprising:
a rail fabricated from a metal and having an interior rail portion and
an exterior rail portion;
a checkrail fabricated from a metal;
a first stile fabricated from a metal;
a second stile fabricated from a metal; and
a first thermal break fabricated from a polymer, the thermal break being an additional component other than the rail, the checkrail, the first stile, and the second stile, wherein the thermal break is only positioned between the interior rail portion and the exterior rail portion of the first sliding sash window, and wherein the thermal break has a single central hollowed-out cavity, the first thermal break comprising an insulating material that connects and supports the interior first sash rail portion and the exterior first sash rail portion, and operates to limit thermal conduction between the interior rail portion and the exterior rail portion; and
a first pivot bar having a first end, a second end, and a longitudinal axis therebetween, wherein the first end of the first pivot bar and at least a portion of the longitudinal axis of the first pivot bar is positioned within and completely encircled by the cavity of the first thermal break, and wherein the second end of the first pivot bar projects out from the first thermal break towards the second jamb of the frame so as to support the first sliding sash window when the first sliding sash window is in one of a plurality of positions;
a second sliding sash window comprising:
a rail fabricated from a metal and having an interior rail portions and an exterior rail portion; and
a checkrail fabricated from a metal;
a first stile fabricated from a metal;
a second stile fabricated from a metal; and
a second thermal break fabricated from a polymer, the thermal break being an additional component other than the rail, the checkrail, the first stile, and the second stile, wherein the thermal break is only positioned between the interior rail portion and the exterior rail portion of the second sliding sash window, and wherein the thermal break has a single central hollowed-out cavity, the second thermal break comprising an insulating material that connects and supports the interior rail portion and the exterior rail portion, and operates to limit thermal conduction between the interior rail portion and the exterior rail portion; and
a second pivot bar having a first end, a second end, and a longitudinal axis therebetween, wherein the first end of the second pivot bar and at least a portion of the longitudinal axis of the second pivot bar is positioned within and completely encircled by the cavity of the second thermal break, and wherein the second end of the second pivot bar projects out from the first thermal break towards the second jamb of the frame so as to support the second sliding sash window when the second sliding sash window is in one of a plurality of positions.

7. The construction product of claim 6, wherein:
the frame comprises a first sill portion, a second sill portion and a thermal break that connects and supports the first and second sill portions.

8. The construction product of claim 6, wherein:
the frame comprises aluminum; and
each sliding sash window comprises a glazing component.

* * * * *